US006691396B2

(12) United States Patent
Martin et al.

(10) Patent No.: US 6,691,396 B2
(45) Date of Patent: Feb. 17, 2004

(54) WET/DRY VACUUM AND METHOD OF ASSEMBLING SAME

(75) Inventors: Michael F. Martin, St. Charles, MO (US); Christopher J. Steger, O Fallon, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/087,431

(22) Filed: Mar. 1, 2002

(65) Prior Publication Data

US 2002/0088103 A1 Jul. 11, 2002

Related U.S. Application Data

(62) Division of application No. 09/517,953, filed on Mar. 3, 2000, now Pat. No. 6,385,809.

(51) Int. Cl.[7] ..... B23P 11/00
(52) U.S. Cl. ..... 29/525.11; 29/469
(58) Field of Search ..... 15/326, 327.6, 15/331, 330, 334, 337; 29/428, 469, 525.01, 525.11

(56) References Cited

U.S. PATENT DOCUMENTS

| | | | | |
|---|---|---|---|---|
| 4,171,208 A | * | 10/1979 | Lowder | 15/327.6 |
| 4,330,899 A | * | 5/1982 | Miller et al. | 15/326 |
| 4,683,608 A | * | 8/1987 | Berfield et al. | 15/328 |
| 4,817,230 A | * | 4/1989 | Kiyooka | 15/330 |
| 5,400,464 A | * | 3/1995 | Steiner | 15/330 |
| 5,477,585 A | * | 12/1995 | Hentzschel et al. | 15/330 |

* cited by examiner

*Primary Examiner*—David P. Bryant
(74) *Attorney, Agent, or Firm*—Howrey Simon Arnold & White LLP

(57) ABSTRACT

A method of assembling a wet/dry vacuum and a wet/dry vacuum assembly in which each of the component parts of the assembly are placed in a fixture and attached to a unit without requiring reorienting the assembly. More specifically, the method includes attaching the various components of the wet/dry vacuum to a lid component, without requiring reorienting the assembly, simplifying the assembly process.

14 Claims, 11 Drawing Sheets

WET/DRY VACUUM AND METHOD OF ASSEMBLING SAME

CROSS-REFERENCE TO RELATED APPLICATION

This application is a division of U.S. patent application Ser. No. 09/517,953, filed on Mar. 3, 2000, now U.S. Pat. No. 6,385,809, the entire contents of which is incorporated by reference.

BACKGROUND OF THE INVENTION

1. Field of the Invention

The invention relates generally to apparatus and assembly for wet/dry utility vacuums with blowing capability. More particularly, the invention relates to a wet/dry utility vacuum capable of switching from a quiet vacuum mode to a blowing mode, and arranged for quick and easy assembly.

2. Description of Related Art

A common feature on many wet/dry utility vacuums is the ability to blow in addition to vacuuming. The blowing feature is typically accomplished by collecting the air exhausted from the suction fan and directing it through an opening in the vacuum. The opening is typically called a blow port. The blow port is usually designed to accept a hose from the vacuum which can be used to further direct the exhaust. The stream of exhausted air can be used for various cleaning tasks. Although the blow port feature is useful, many manufacturers of wet/dry vacuums have eliminated it to facilitate noise reduction.

Vacuums with blowing ports usually exhibit a direct path from the blowing port to the suction fan. This direct path provides a direct route for sound generated by the suction fan to escape the vacuum. Efforts to reduce the amount of sound generated by vacuums often include eliminating blow ports and creating indirect exhaust paths. Indirect exhaust paths utilize abrupt turns and sound absorbing foam to provide sound reduction and mechanical absorption of the noise energy created by the suction fan. A number of drawbacks to this method of sound reduction exist. First, the blowing port, a useful feature of the wet/dry vacuum, is eliminated. Second, there tends to be a performance loss stemming from the restrictions caused by abrupt redirection of the exhaust.

Other problems confronting wet/dry vacuum manufacturers include the inefficient assembly process of the various components into a working vacuum, and the potential for water to leak into the motor during wet vacuuming operations. Often a vacuum assembly requires several re-orientations of the apparatus to fasten components together. These re-orientations result from vacuum designs that require fasteners such as screws to be inserted between components at many different angles above and beneath the apparatus. For each incidence of required re-orientation during the assembly process, time and energy is inefficiently spent. In addition, the seals isolating the motor from any water during wet pick-up operations are often less than satisfactory. Any water introduced into the motor chamber has the potential to damage or destroy the motor, so there is a need for fail-safe design to eliminate the possibility of water leaking into compartments that contain electrical components.

The present invention is directed to overcoming, or at least reducing the effects of, one or more of the issues set forth above.

SUMMARY OF THE INVENTION

In accordance with one embodiment of the disclosed method and apparatus is a gasketless, noise reduced, wet/dry vacuum with blowing capability. The vacuum includes a body having a main air passageway, and first and second air passageways diverging from the main passageway. The first air passageway defines a blower port. A closable door having an open and a closed position directs air flow from the main air passageway to either the first or second diverging air passageways to switch between vacuum and blowing modes.

In one embodiment the wet/dry vacuum assembly is arranged such that each of the component parts may be placed in an assembly fixture and attached to a unit without reorienting the assembly.

BRIEF DESCRIPTION OF THE DRAWINGS

The foregoing and other features and aspects of the invention will become further apparent upon reading the following detailed description and upon reference to the drawings in which.

Figure 1:
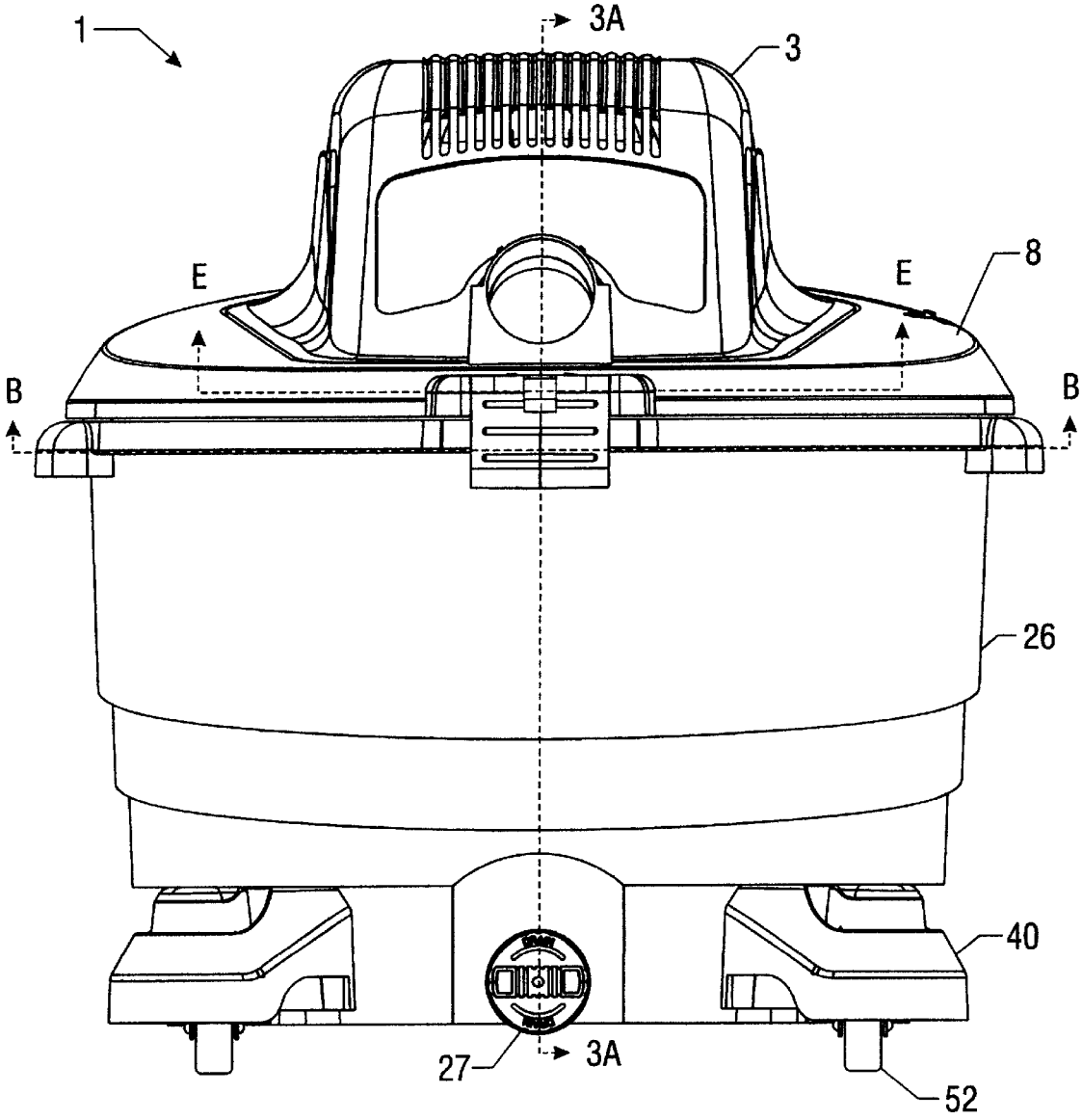
FIG. 1 is a front view of a wet/dry vacuum assembly according to one embodiment of the disclosed method and apparatus.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Turning now to the drawings, and in particular to FIG. 1, a wet/dry vacuum assembly 1 in accordance with one embodiment of the disclosed method and apparatus is shown. Vacuum assembly 1 is shown in FIG. 1 as a completed unit with a motor cover 3 attached to a lid 8. The attachment of motor cover 3 to lid 8 may be accomplished by a plurality of fasteners, including, but not limited to, a set of screws 10 seen in FIG. 4. Lid 8 releaseably attaches to a drum 26 by latches 23, the drum housing any fluid or debris (wet or dry) introduced into the vacuum during normal suction operations. Attached to drum 26 are four individual caster feet, 40, each containing a caster 52. Casters 52 facilitate movement of vacuum 1 at the convenience of an operator. Lid 8 isolates a motor 7 from drum 26 to prevent contamination from liquid and debris entering the vacuum during normal operation.

Figure 2:
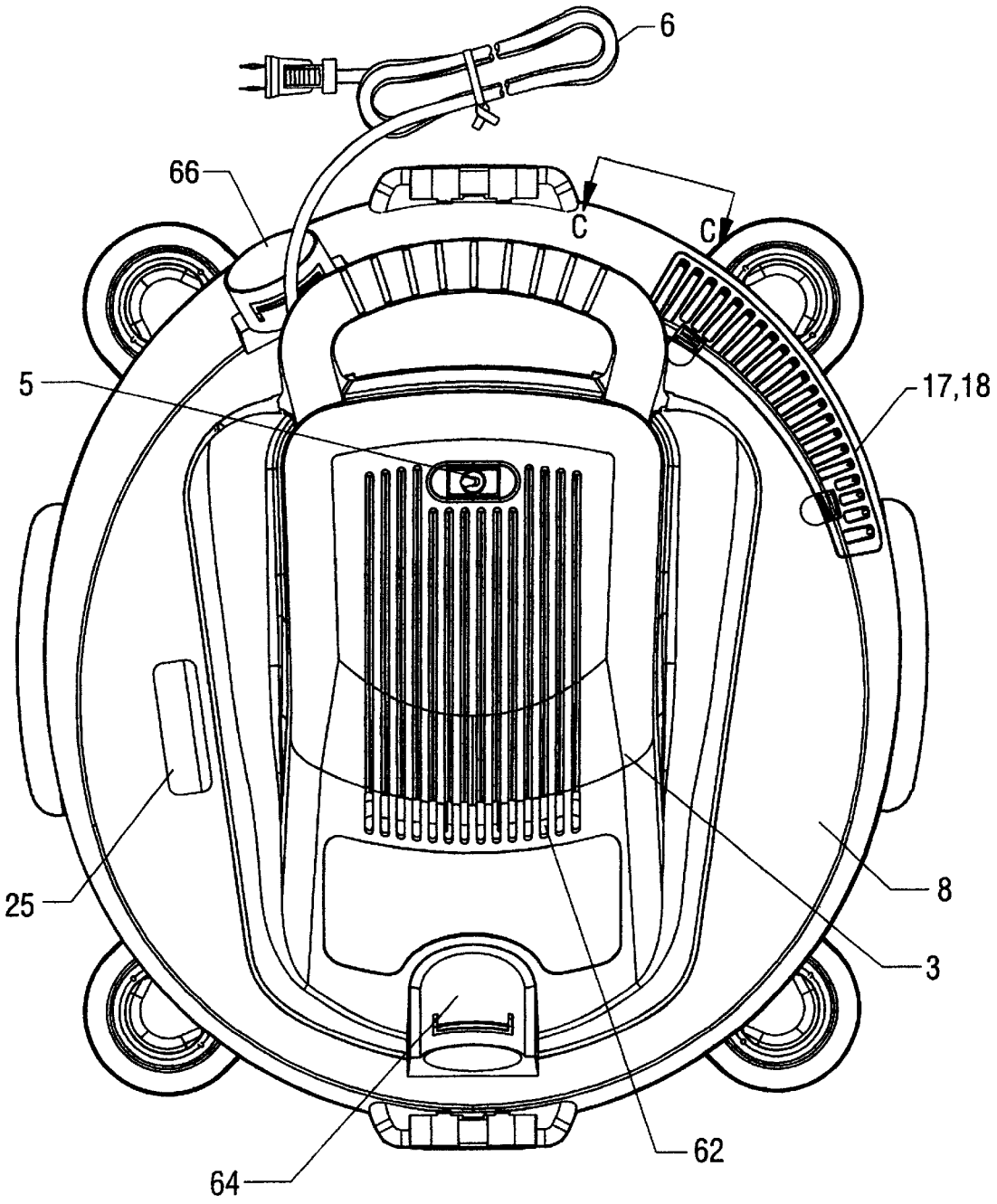
FIG. 2 is a top view of the wet/dry vacuum assembly shown in FIG. 1.
Figure 5:
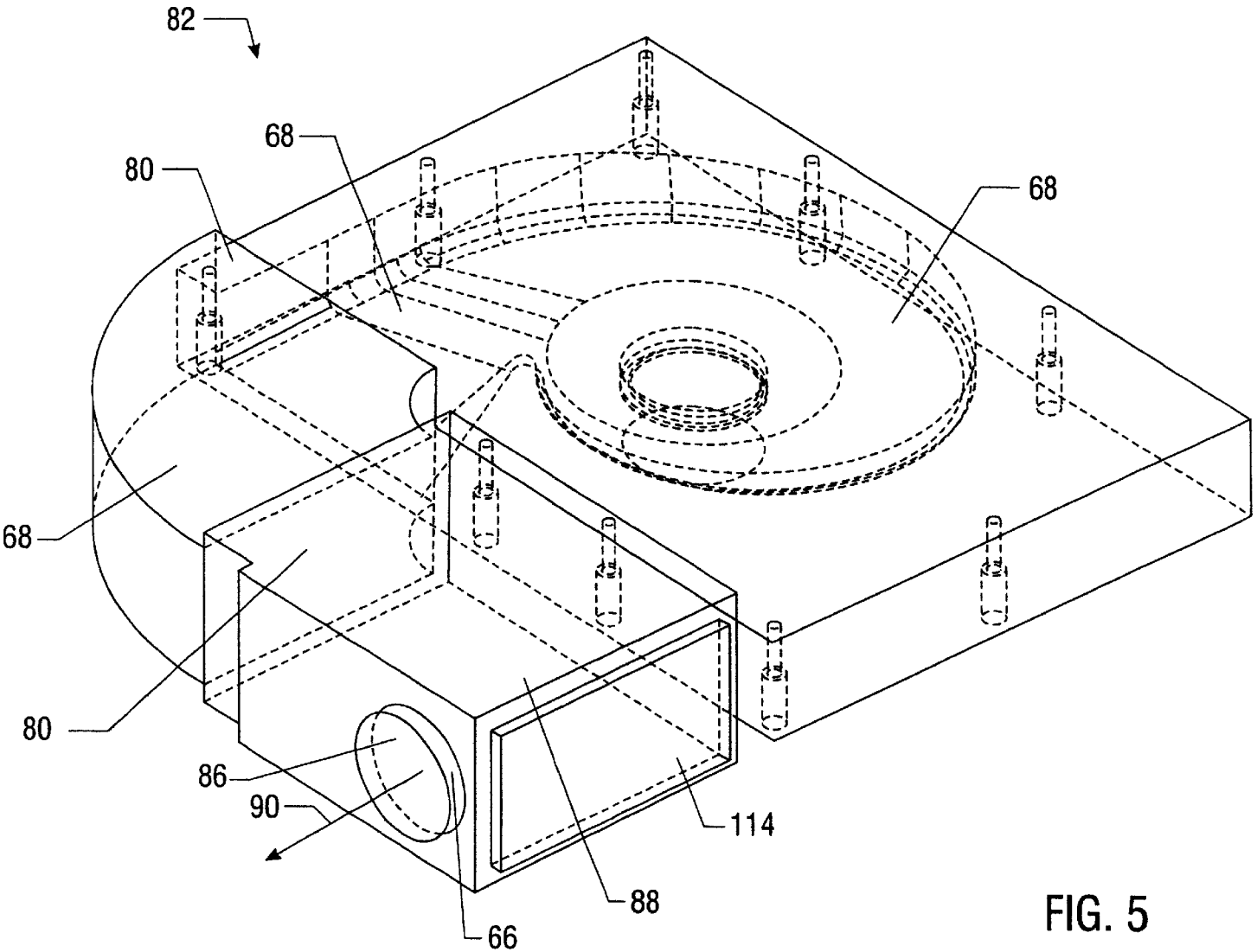
FIG. 5 is a conceptual figure for a wet/dry vacuum exhaust assembly according to one embodiment of the disclosed method and apparatus.

Referring next to FIG. 2, a top view of vacuum assembly 1 is shown. According to the embodiment of FIG. 2, vacuum assembly 1 includes motor cover 3, lid 8, cord 6, suction port 64, blowing port 66, switch 5, exhaust door 17, and motor exhaust port 62. Housed behind exhaust door 17 is a muffling device 18, which is more clearly seen in cross-section in FIGS. 3A and 3B. Muffling device 18 may be comprised of, but is not limited to, open cell foam. The open cell foam may include polyether or other suitable materials. Muffling device 18 allows the passage of air therethrough while absorbing sound energy generated by a motor 7, thereby increasing the comfort of an operator by reducing noise transmission. During normal operation of vacuum assembly 1, suction air is introduced into a main passageway, for example exhaust air passageway 68 (shown in concept in FIG. 5, also shown in FIG. 6) and out through muffling device 18. The details of the air flow are discussed below.

Figure 3A:
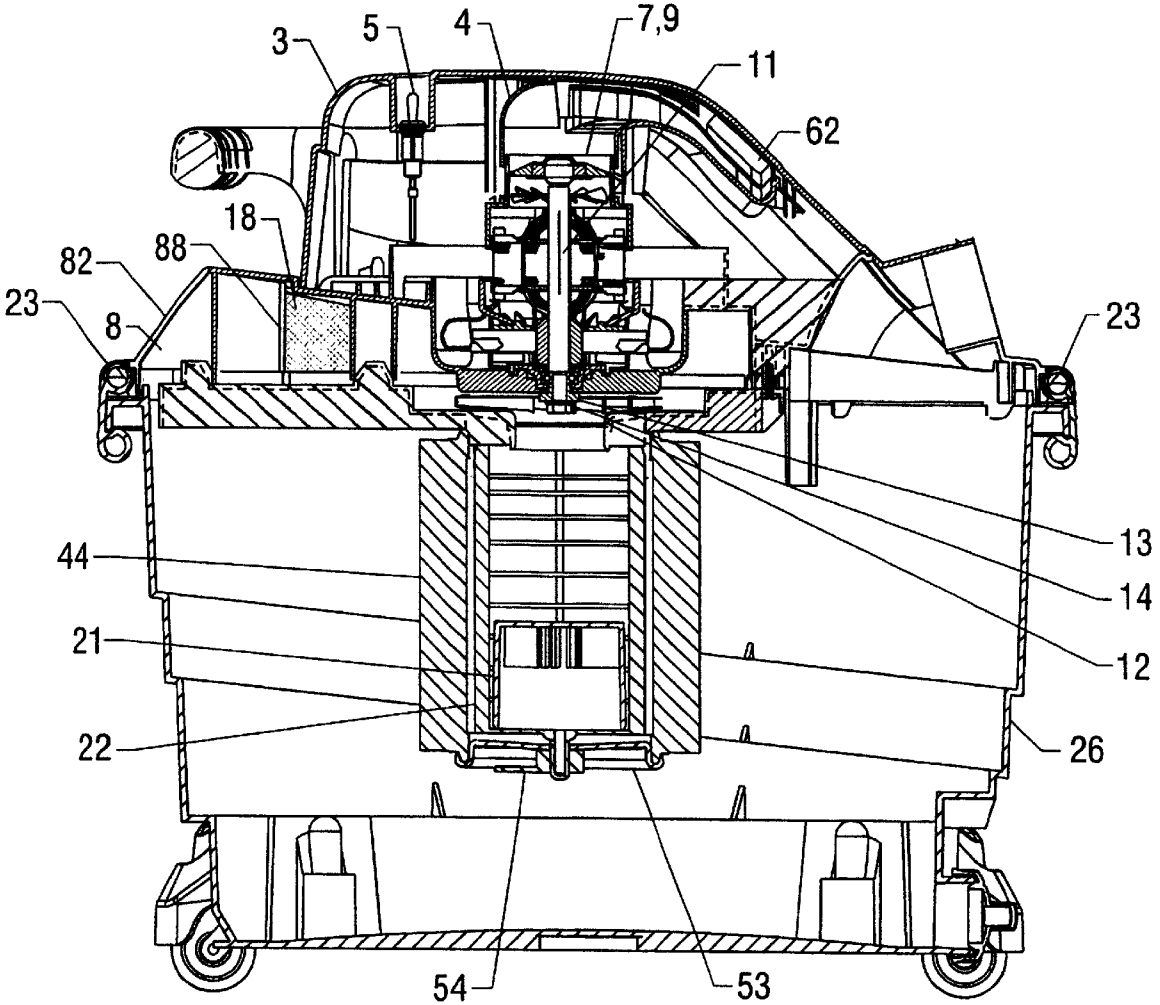
FIG. 3A is a section view of the embodiment of a wet/dry vacuum assembly shown in FIG. 1, taken along line A—A.
Figure 3B:
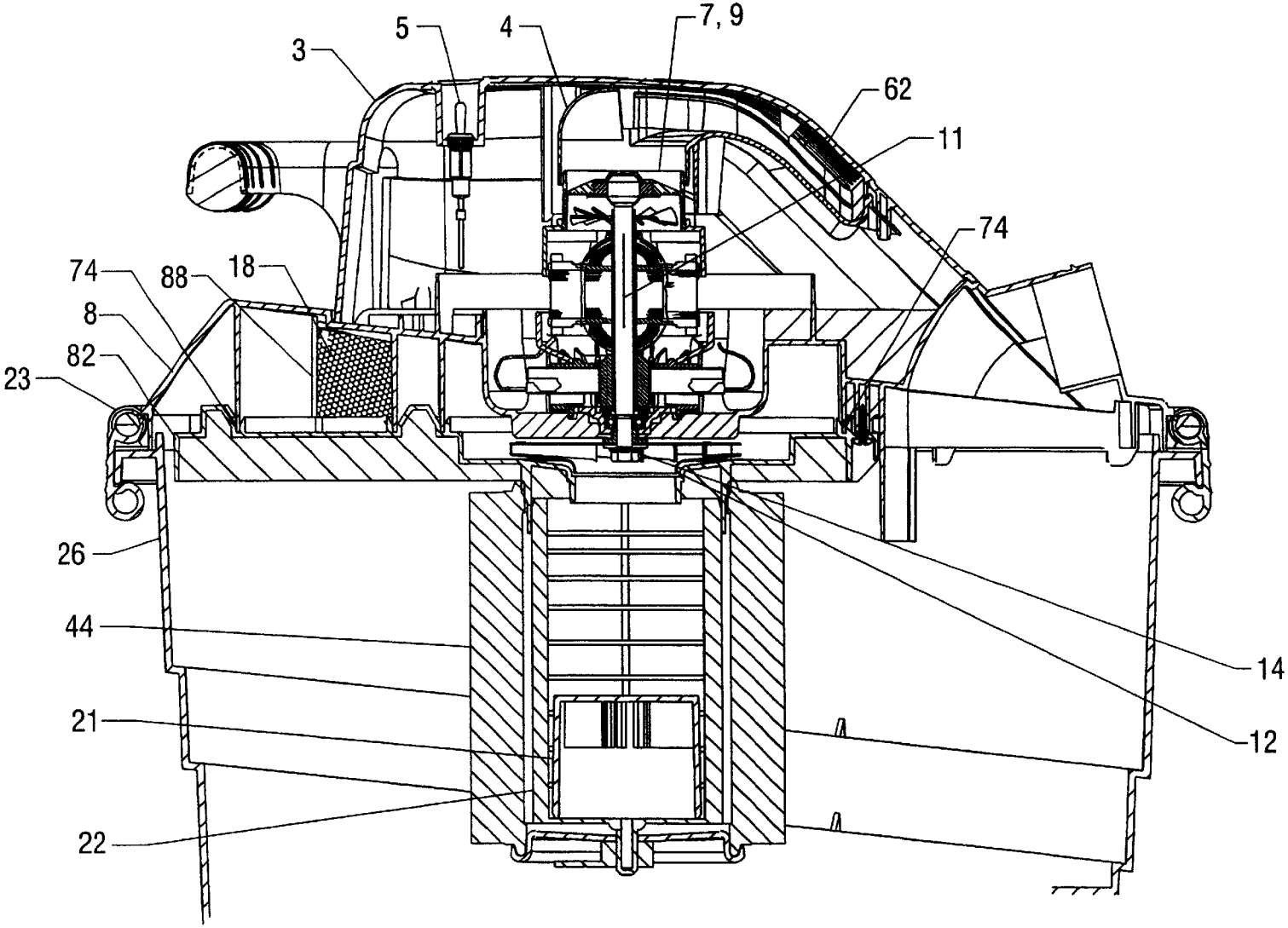
FIG. 3B is an enlarged view of FIG. 3A.

Referring to FIGS. 3A and 3B, a cross section of wet/dry vacuum assembly 1 according to one embodiment of the disclosed method and apparatus is shown. FIG. 3A shows muffling device 18 housed within an air passageway 88. Motor 7 is shown nested inside motor cover 3. A motor exhaust diverter 4 redirects the motor exhaust (used to cool the motor) that passes by the motor vertically to a generally horizontal exit point through motor exhaust port 62. The redirected air out the front of the vacuum through motor exhaust port 62, as opposed to typical motor air exhaust ports which are located in the top of the motor cover, provides for less noise and inconvenience to the operator of the vacuum. Thus, one purpose of air diverter 4 is to direct exhaust air and noise away from the operator. Air diverter 4 is just one illustration of an embodiment to accomplish this purpose.

In addition, there is a reduced risk of water contamination due to rain or other sources entering motor cover 3 with motor exhaust port 62 located toward the front of vacuum assembly 1.

Attached to motor 7 is a blower wheel 12. Blower wheel 12 may be attached to motor 7 by a nut 14 threadably connecting to a motor shaft 11. Located below the blower wheel and extending into drum 26 are a float 21 and filter cage 22. A standard filter 44 fits snugly over filter cage 22.

Referring to FIG. 3B, lid 8 seals against a plate collector 19 via a gasketless tongue and groove seal 74. Tongue and groove seal 74 provides for an interference fit. Tongue and groove seal 74 eliminates the need for a gasket and thus the logistical problems associated therewith. Tongue and groove seal 74 is located on the drum 26 side of lid 8. With the entire tongue and groove seal 74 between lid 8 and plate collector 19 located on the drum 26 side of lid 8, the possibility of water contamination into motor 7 due to a leak, for example, is eliminated.

Figure 4:
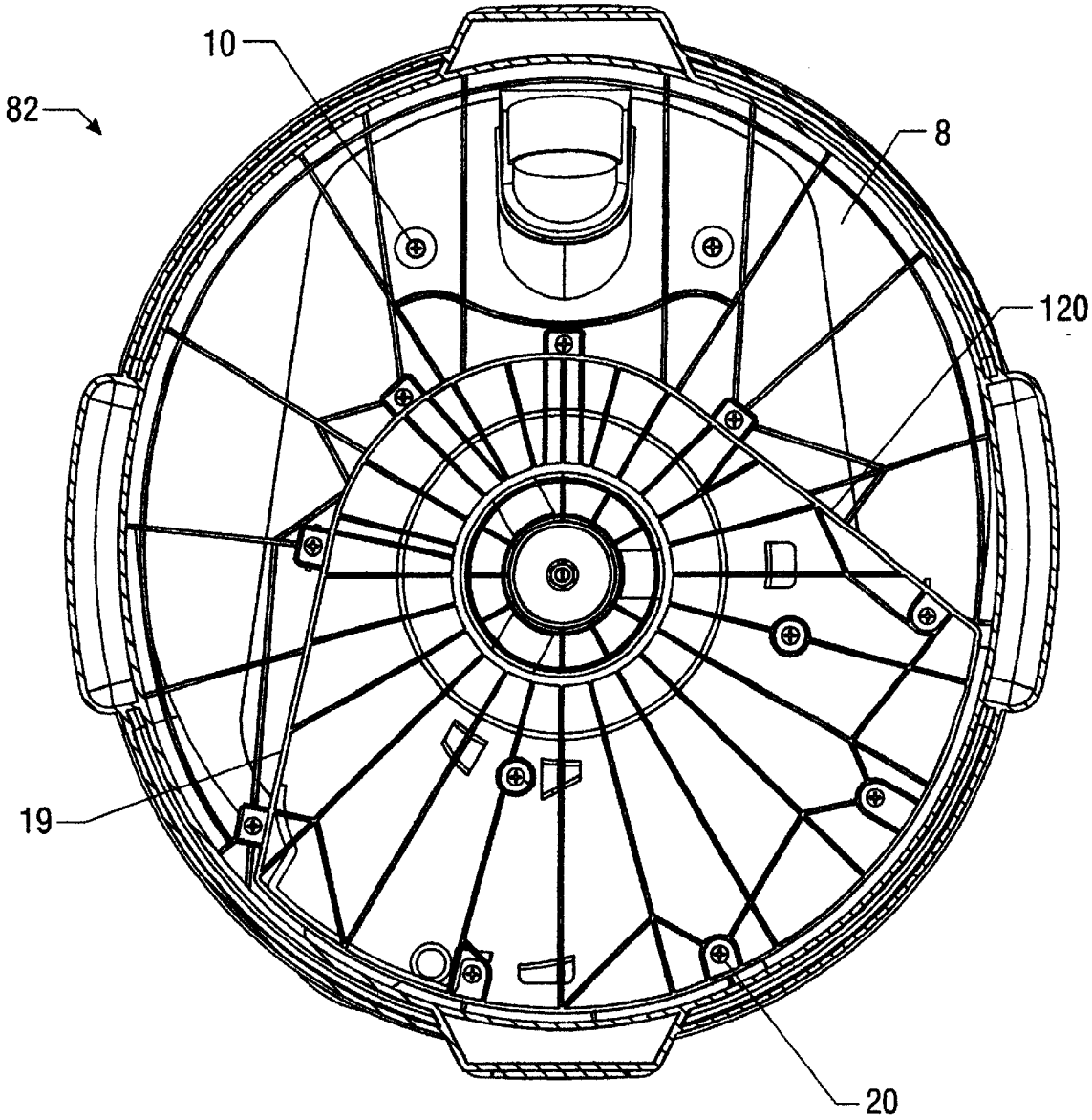
FIG. 4 is a bottom view of the embodiment of a wet/dry vacuum assembly shown in FIG. 1, taken along line B—B.

Referring next to FIG. 4, plate collector 19 is connected to lid 8 by a plurality of fasteners 20 including, but not limited to, screws. The combination of plate collector 19 and lid 8 comprise a body 82. A main passageway, for example, exhaust air passageway 68, is defined between plate collector 19 and lid 8. Exhaust air passageway 68 provides an initial path for exhaust air to escape the drum during operation of the wet/dry vacuum. Exhaust air passageway 68 can be seen in a perspective view in FIG. 5.

Exhaust air passageway 68 exhibits an increasing cross sectional area 80. In one embodiment the air passageway increases from an initial cross sectional area of approximately 5.25 in.$^2$ to approximately 12.66 in.$^2$ In some embodiments the cross sectional area of the air passageway increases approximately 40%, but smaller or greater percentage increases are also within the scope of the invention. The increasing cross sectional area decreases the velocity of air traversing the passageway, which in turn decreases the noise generated by the moving air.

A first 86 and a second air passageway 88 diverge from exhaust passageway 68. First air passageway 86 defines an air path for blower port 66, which is receptive of a blower attachment, for example a hose adapter (not shown). Blower port 66 enables vacuum assembly 1 to be operated as blower.

Figure 6:
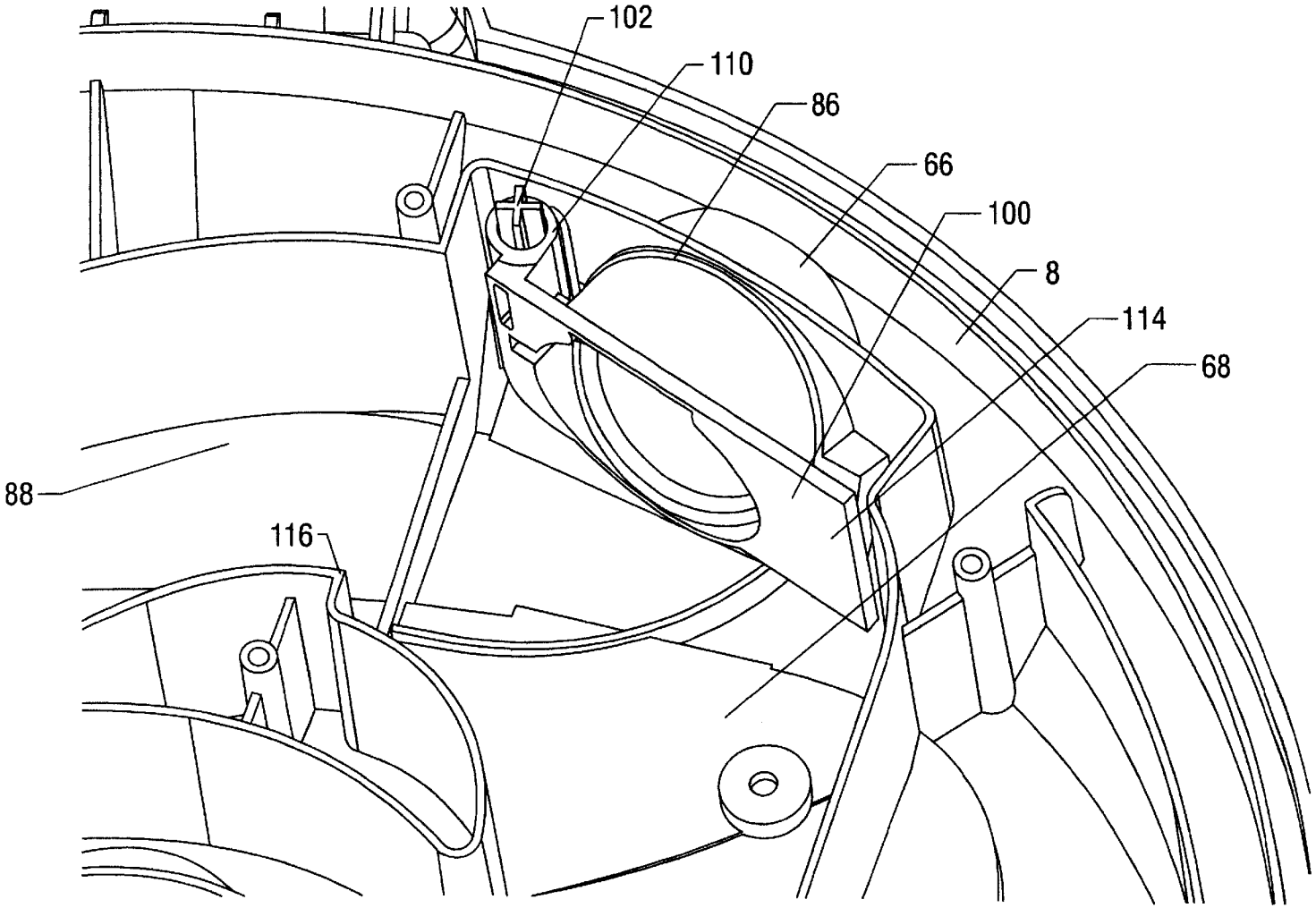
FIG. 6 is a perspective view of a wet/dry vacuum assembly in the sound reduced vacuuming mode according to one embodiment of the disclosed method and apparatus.

Referring next to FIG. 6, blower port 66 is adjacent to a closable door 100, which seals off blower port 66 during normal quiet vacuum operation. Closable door 100 may be made of a resilient plastic material or other suitable material. In one embodiment the length and width dimensions of closable door 100 are approximately 3.75 in. by 2.0 in., respectively. Closable door 100 exhibits an open and a closed position and is one structure whereby vacuum assembly 1 may switch between a normal quiet vacuum/suction operation and a blower mode. Closable door 100 may be mounted between lid 8 and plate collector 19 (not shown in FIG. 6 for clarity) on a post 102. Post 102 may be, for example, the cross-shaped post shown in FIG. 6, which acts as a rotation point or hinge for closable door 100. Post 102 provides for a loose-hinged connection, allowing closable door 100 to self-adjust in response to air pressure such that a tight seal may be formed between the door and second passageway 88. The details of closable door 100 can be seen in FIG. 8.

Figure 7:
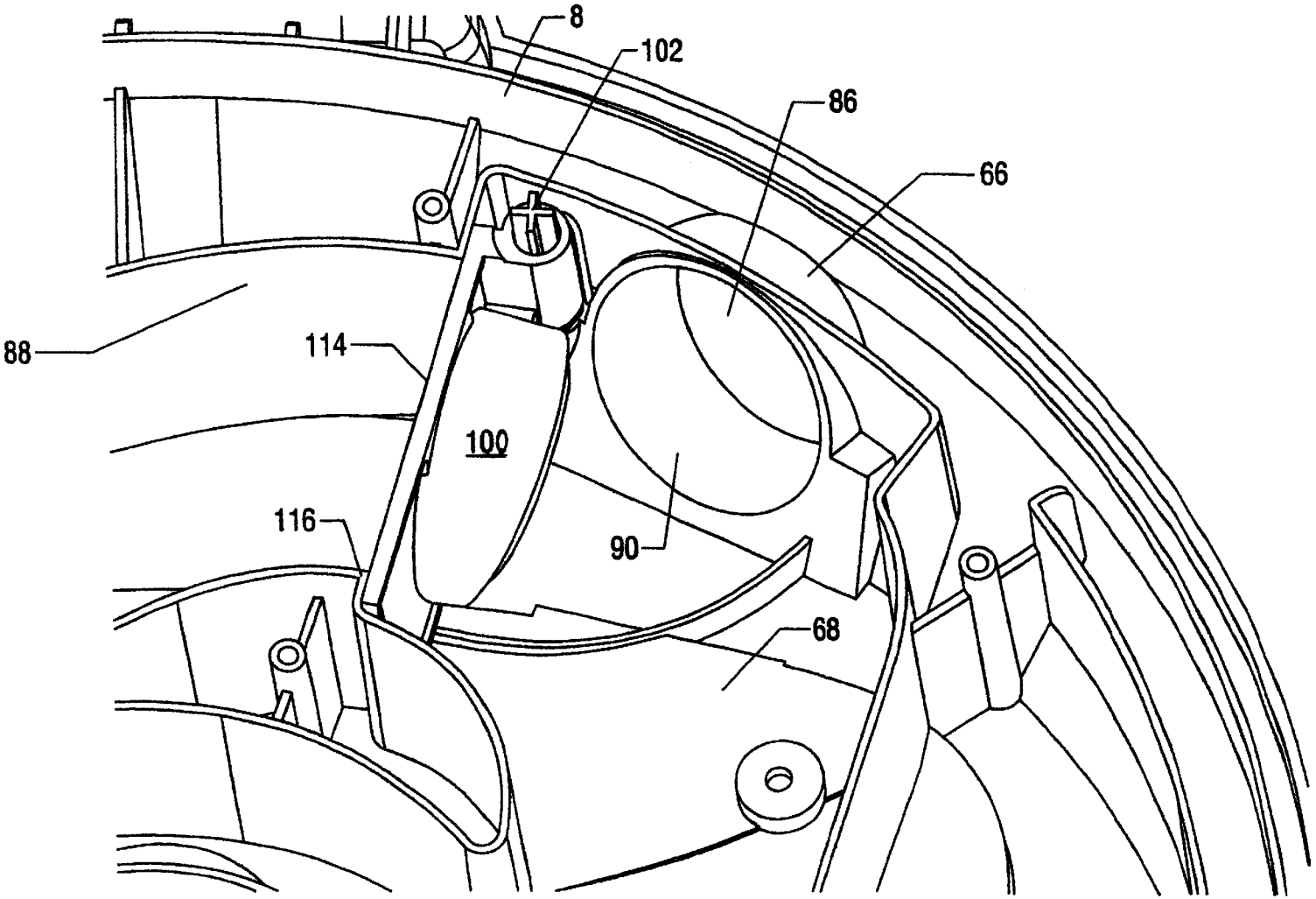
FIG. 7 is a perspective view of a wet/dry vacuum assembly in the blowing mode according to one embodiment of the disclosed method and apparatus.
Figure 8:
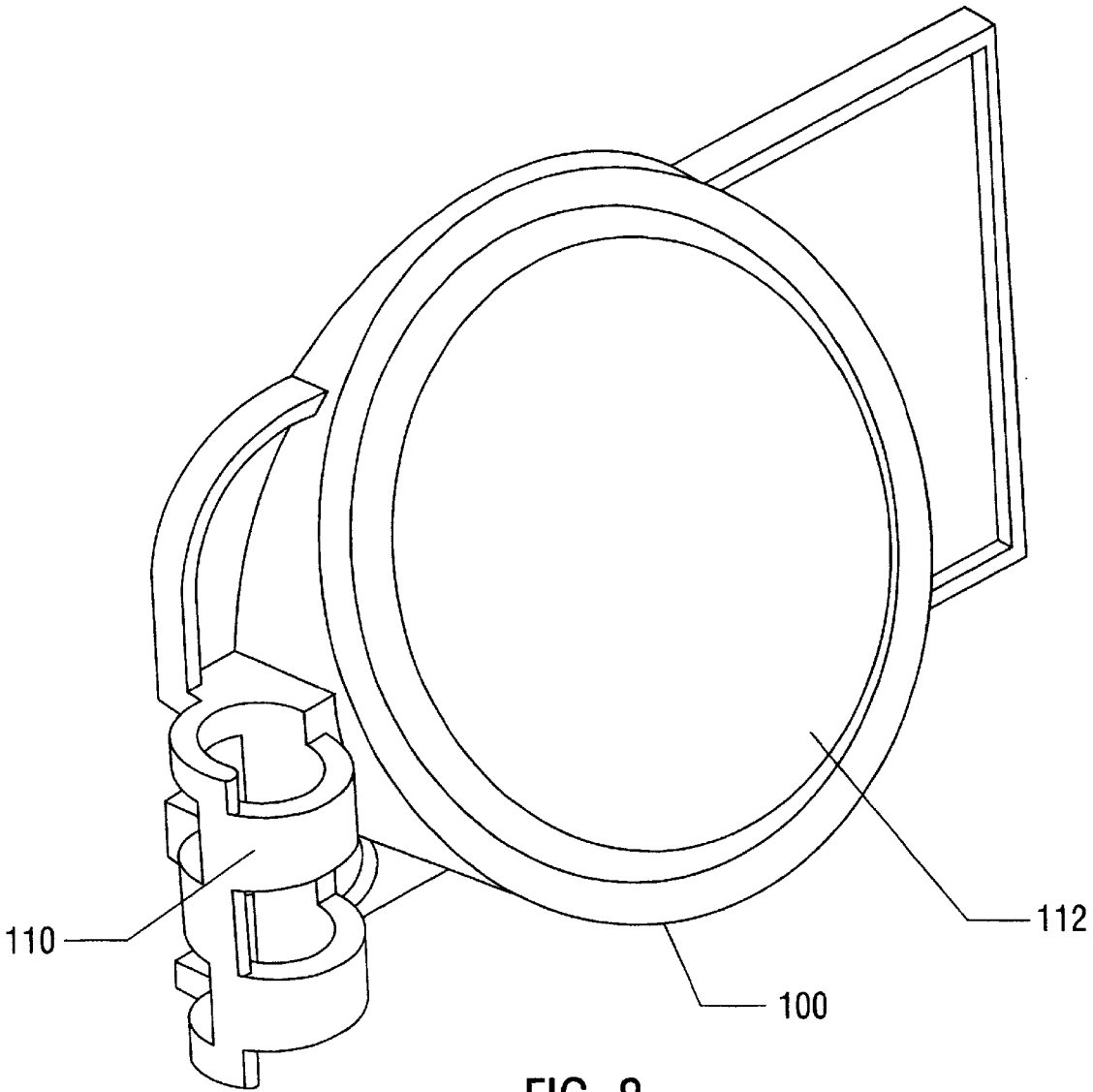
FIG. 8 is a perspective view of a closable door for a wet/dry vacuum assembly according to one embodiment of the disclosed method and apparatus.

Referring to FIG. 8, closable door 100 comprises a hinge 110 on a first end. Closable door 100 is semi-rectangular in shape and includes a circular face 112. Circular face 112 is sealable against blower port 66. It will be understood that closable door 100 may also comprise any other shape to accomplishes a seal with blower port 66. Opposite circular face 112, is a rectangular face 114 which can be seen in FIGS. 6 and 7. Rectangular face 114 is sealable with an edge 116 of lid 8. Rectangular face 114 is dimensioned such that it completely covers second air passageway 88 when the vacuum is in the blower mode as discussed below.

Placed adjacent to closable door 100 is a biasing member, for example spring 104, attached to closable door 100.

Figure 9:
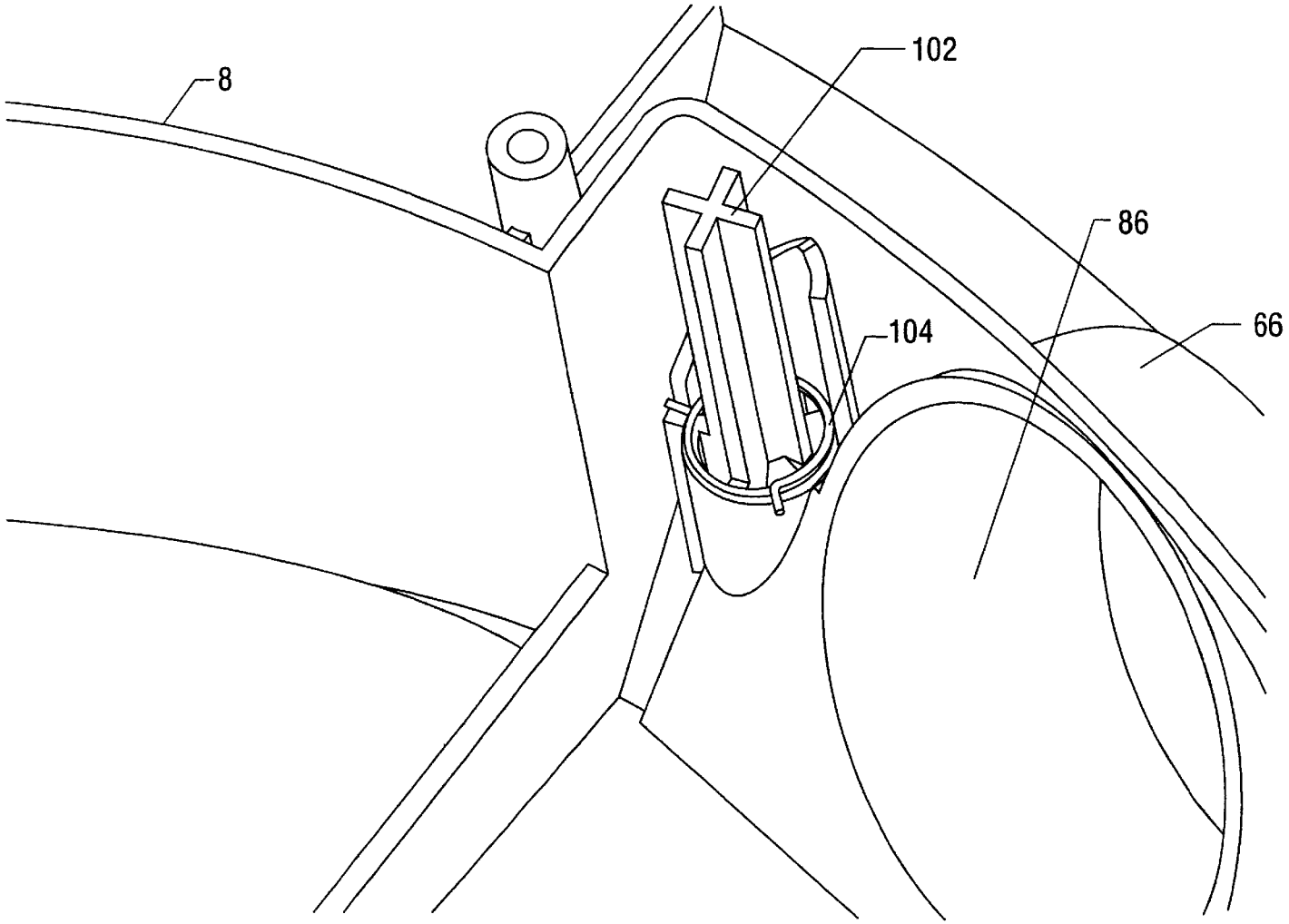
FIG. 9 is a perspective view of a closable door reception post for a wet/dry vacuum assembly according to one embodiment of the disclosed method and apparatus.

Spring 104 biases the closable door in a predetermined position, for example the closed position shown in FIG. 6, by exerting a force on closable door 100. In one embodiment, a force of approximately 0.3 pounds is exerted near the pivot of the door to bias the door in the closed position. However, the spring force of 0.3 pounds may not be equal to the force required to open the door. Spring 104 is shown in FIG. 9.

Referring again to FIG. 6, when vacuum assembly 1 is in an "OFF" position, meaning that power to blower wheel 12 is interrupted, closable door 100 is closed and seals off first passageway 86 to blower port 66. Spring 104 urges closable door 100 to this closed position. When vacuum assembly 1 is switched to an "ON" position with power supplied to blower wheel 12, exhaust air enters main passageway 68. The increased internal air pressure caused by the exhaust air forced into exhaust passageway 68 tends to force closable door 100 closed and thus enhances the seal between the door and blow port 66. The exhaust air is thus directed through second air passageway 88. Second air passageway 88, like exhaust air passageway 68, exhibits an increasing cross sectional area to reduce the velocity of air moving therethrough. In addition, muffling device 18 is positioned snugly within second air passageway 88 as seen in FIGS. 3A and 3B. As exhaust air is forced through muffing device 18, energy is absorbed by the muffling device and noise transmissions are reduced. Thus, vacuum assembly 1 may be run in a quiet, vacuuming mode.

However, if desired, wet/dry vacuum assembly 1 can also be used as a blower. In order to switch vacuum assembly 1 into a blower mode, the operator may insert a blower attachment, for example a hose adaptor (not shown), into blower port 66. The blower attachment makes contact with circular face 112 of closable door 100 as it is inserted into blower port 66. When the inserting force exceeds the closing force of spring 104, closable door 100 rotates about post 102 on hinge 110 to the open position. When vacuum assembly 1 is in the "OFF" position, the blower attachment (not shown) will remain in contact with circular face 112 as spring 104 biases closable door 100 to a predetermined position, for example the closed position shown in FIG. 6.

When vacuum assembly 1 is "ON", the air pressure within exhaust air passageway 68 is increased by the exhaust forced therethrough by blower wheel 12. If closable door 100 is in a substantially open position and vacuum assembly 1 is "ON", Spring 104 exerts a closing force on closable door 100 which is less than the opening force exerted on the door by the exhaust air pressure on the circular face 112 side of the closable door. Thus, with the blower attachment inserted, the exhaust air pressure on closable door 100 causes the door to adjust to a sealed open position and seal off second air passageway 88 by meeting edge 116 of lid 8. Exhaust air is then forced through first air passageway 86 of blower port 66, continuing through the blower attachment (not shown) used by the operator. FIG. 7 shows closable door 100 in the blowing or open position herein described, with blower port 66 open. An arrow 90 in FIGS. 5 and 7 indicates the exhaust air flow direction in this position. In some embodiments, if the blower attachment (not shown) is removed while the vacuum is "ON", the closable door will remain open as the force applied to the door by spring 104 is smaller than the force created by the air pressure on the door area. When vacuum assembly 1 is switched "OFF", the spring force is sufficient to rotate closable door 100 back to the closed position shown in FIG. 6.

The assembly of vacuum assembly 1 is next discussed. Vacuum assembly 1 is arranged as shown in FIGS. 1–10 such that each of the components may be placed in an assembly fixture and attached to a unit without re-orienting the assembly. This is a considerable advantage over present wet/dry vacuum assemblies that require fasteners to be connected from two or more different directions, slowing assembly time and increasing assembly costs. The method of assembly for vacuum assembly 1 may be accomplished in a single orientation position as follows.

Motor cover 3 is provided with switch 5 and air diverter 4 connected thereto. Motor cover 3 may be placed upside down to facilitate assembly. Next, motor 7 is placed inside motor cover 3. Lead wires (not shown) from switch 5 and cord 6 are connected to motor 7. Next, lid 8 is placed over motor 7 and motor cover 3. Lid 8 is attached to motor 7 and motor cover 3 by a plurality of fasteners, for example, screws 10. In one embodiment, motor 7 is attached only to lid 8, and not in direct contact with motor cover 3, thus minimizing noise transmissions through motor cover 3.

Closable door 100 and spring 104 are placed over post 102 of lid 8, with spring 104 biasing closable door 100 to the closed position. Blower wheel 12 is attached to motor shaft 11. Because shaft 11 of motor 7 is free to rotate during blower wheel attachment, in one embodiment a nut 13 is held in place while shaft 11 is rotated into the nut to secure blower wheel 12 onto shaft 11. Next, collector plate 19 is sealably connected to lid 8 by a plurality of fasteners, for example, screws 20. In one embodiment the sealing connection between lid 8 and collector plate 19 is a gasketless tongue and groove interference-fit, however, other interference fitting seals or other sealing connections may be used. The entire seal between collector plate 19 and lid 8 is internal to the drum 26 of the vacuum, eliminating the risk for water leakage into motor 7 during wet pick-ups. Following the connection of collector plate 19 to lid 8, vacuum assembly 1 may be packaged with drum 26 for shipping to consumers. Each of the assembling operations may be accomplished as described above while vacuum assembly 1 is in a single orientation position. In one embodiment all fasteners are attached to vacuum assembly in a single direction, for example a direction substantially normal to the drum 26 side of lid 8.

Figure 10:
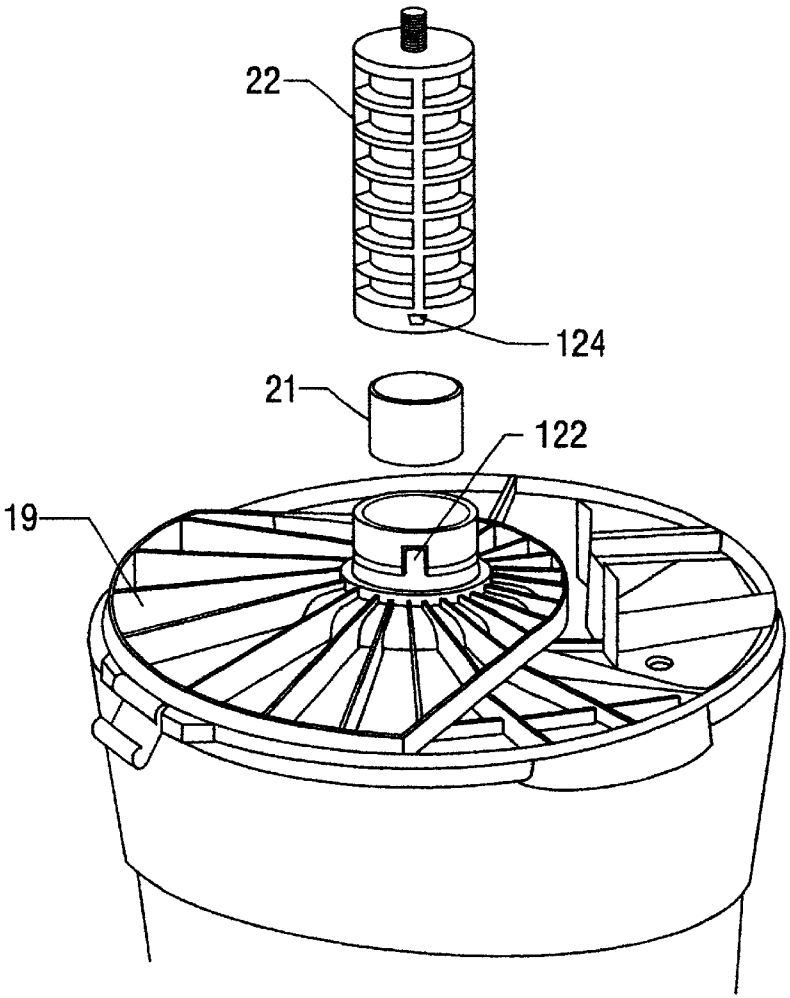
FIG. 10 is a perspective view of a filter cage and float assembly for a wet/dry vacuum according to one embodiment of the disclosed method and apparatus.

Packaged with vacuum assembly 1 and drum 26 may be a float 21, filter cage 22, filter 44, and muffling device 18, each of which may be installed by the consumer. Muffling device 18 may be inserted into second air passageway 86 by opening access door 17. Filter cage 22 may be connected to collector plate 19 by a plurality of fasteners, for example notches 122 on collector plate 19 may connect with mating tabs 124 on filter cage 22, as seen in FIG. 10. Filter 44 may be placed snugly over filter cage 22.

While the present invention has been particularly shown and described with reference to a particular illustrative embodiment thereof, it will be understood by those skilled in the art that various changes in form and details may be made without departing from the spirit and scope of the invention. The above-described embodiment is intended to be merely illustrative, and should not be considered as limiting the scope of the present invention.

What is claimed is:

1. A method of assembling a wet/dry vacuum comprising the steps of:

a) attaching a switch and air diverter to a motor cover;

b) placing a motor in the motor cover;

c) placing a lid over the motor cover and motor;

d) attaching the motor to the lid;

e) attaching the lid to the motor cover;

f) attaching a closable door to the lid;

g) attaching a blower wheel to a shaft of the motor such that the motor is situated on a first side of the lid and the blower wheel is situated on a second side of the lid opposite the first side; and h) attaching a collector plate to the lid.

2. The method of claim 1 wherein each of steps b–h is performed without reorienting the vacuum.

3. The method of claim 1 wherein the step of attaching the motor to the lid is accomplished such that the motor is not in direct contact with the motor cover.

4. The method of claim 1 wherein the step of placing the motor in the motor cover further comprises attaching a lead wire and a cord to the switch and the motor.

5. The method of claim 1 wherein the blower wheel is attached to the shaft of the motor by rotating the shaft into a threaded nut.

6. The method of claim 1 wherein the blower wheel is situated between the lid and the collector plate.

7. The method of claim 1 wherein the closable door is situated between the lid and the collector plate.

8. The method of claim 7 wherein the closable door is oriented generally transversely to the lid.

9. A method of assembling a wet/dry vacuum comprising the steps of:

a) placing a lid over a motor;

b) attaching the motor to the lid;

c) attaching a closable door to the lid;

d) attaching a collector plate to the lid such that the closable door is situated between the lid and the collector plate; and e) attaching a blower wheel to a shaft of the motor.

10. The method of claim 9 wherein steps a–e are performed with the vacuum in a single orientation position.

11. The method of claim 10 further comprising placing the motor in a motor cover.

12. The method of claim 11 further comprising attaching a switch and air diverter to the motor cover.

13. The method of claim 9 wherein the blower wheel is situated between the lid and the collector plate.

14. The method of claim 9 wherein the motor is situated on a first side of the lid and the blower wheel is situated on a second side of the lid opposite the first side.

* * * * *